US009642431B2

(12) United States Patent
Sze

(10) Patent No.: US 9,642,431 B2
(45) Date of Patent: May 9, 2017

(54) HAIR CLIPPING DEVICE

(71) Applicant: Tung Hing Plastic Manufactory Ltd., Kowloon (HK)

(72) Inventor: Ka Chuen Sze, Kowloon (CN)

(73) Assignee: TUNG HING PLASTIC MANUFACTORY LTD., Kowloon (CN)

( * ) Notice: Subject to any disclaimer, the term of this patent is extended or adjusted under 35 U.S.C. 154(b) by 0 days.

(21) Appl. No.: 14/606,470

(22) Filed: Jan. 27, 2015

(65) Prior Publication Data

US 2015/0230578 A1 Aug. 20, 2015

(30) Foreign Application Priority Data

Feb. 14, 2014 (GB) ..... 1402637.1

(51) Int. Cl.

| | |
|---|---|
| ***A45D 8/06*** | (2006.01) |
| ***A45D 8/14*** | (2006.01) |
| ***B21F 45/00*** | (2006.01) |
| ***B21G 7/06*** | (2006.01) |

(52) U.S. Cl.

CPC ..... *A45D 8/14* (2013.01); *B21F 45/00* (2013.01); *B21G 7/06* (2013.01)

(58) Field of Classification Search

CPC ... A45D 8/14; A45D 8/02; A45D 8/04; A45D 8/06; A45D 8/08; A45D 8/16; A45D 8/36; A45D 2007/002; B21G 7/06; B21G 7/00; B21G 7/02; B21G 7/04; B21F 45/00; B21F 45/16; B21F 19/00

USPC ..... 132/280, 200, 59, 60, 63.1, 72.1, 212, 132/264, 273, 276, 277, 279, 281–284; 140/87

See application file for complete search history.

(56) References Cited

U.S. PATENT DOCUMENTS

| | | | | | |
|---|---|---|---|---|---|
| 515,745 | A | * | 3/1894 | Caldwell | 132/280 |
| 562,690 | A | * | 6/1896 | Young | 132/280 |
| 706,036 | A | * | 8/1902 | Dun Lany | 132/280 |
| 708,959 | A | * | 9/1902 | Harrison | 132/284 |
| 1,272,209 | A | * | 7/1918 | Burke | 132/283 |
| 1,410,948 | A | * | 3/1922 | Miller | 132/283 |
| 1,834,153 | A | * | 12/1931 | Haims | 132/277 |
| 2,070,939 | A | * | 2/1937 | Whitney | 132/278 |
| 2,075,194 | A | * | 3/1937 | Clark | 132/284 |
| 3,540,491 | A | * | 11/1970 | Solomon | 140/87 |

(Continued)

FOREIGN PATENT DOCUMENTS

| | | |
|---|---|---|
| CA | 831304 A | 1/1970 |
| GB | 425446 | 3/1935 |
| GB | 655918 | 8/1951 |

OTHER PUBLICATIONS http://www.amazon.com/Scunci-No-slip-Beautiful-Blends-48-Count/dp/B0045HWN22/ref. (2011).*

*Primary Examiner* — Rachel Steitz

(74) *Attorney, Agent, or Firm* — Heslin Rothenberg Farley & Mesiti P.C.; Kristian E. Ziegler; Melvin Li

(57) ABSTRACT

There is provided a hair clipping device. The hair clip has a first leg portion and a second leg portion formed from a wire configured by bending such that the first and second leg portions lie adjacent and are biased against each other for securing hair therebetween. Surface of the first and second leg portions is provided with an anti-slipping coating for enhancing gripping of hair arranged between the first and second leg portions by the hair clip.

6 Claims, 2 Drawing Sheets

(56) References Cited

U.S. PATENT DOCUMENTS

| | | | | |
|---|---|---|---|---|
| 3,915,203 | A * | 10/1975 | Solomon | 140/87 |
| 5,819,761 | A * | 10/1998 | Sloan | 132/210 |
| 8,307,835 | B2 * | 11/2012 | King | 132/200 |
| 2006/0021631 | A1 * | 2/2006 | Lafauci | 132/277 |
| 2006/0162046 | A1 * | 7/2006 | Chudzik | A45D 8/36 2/174 |
| 2006/0174909 | A1 | 8/2006 | Vestal et al. | |
| 2007/0256702 | A1 * | 11/2007 | Traver et al. | 132/280 |

* cited by examiner

HAIR CLIPPING DEVICE

FIELD OF THE INVENTION

The present invention is concerned with a hair clipping device such as a hair pin.

BACKGROUND OF THE INVENTION

There are a variety of hair clipping or organizing devices in the market designed to suit different needs. However, many such devices suffer from different problems. For example, some devices are easy to break, while some others are too complicated with many small mechanical parts (e.g. spring) and they tend to cause tangling of hair to these parts.

The present invention seeks to provide an improved hair clipping device to allow a user to secure hair effectively and reliably and yet to ensure easy removal of the devices when needed, or at least to provide the public with a useful alternative.

SUMMARY OF THE INVENTION

According to a first aspect of the present invention, there is provided a hair pin comprising a first leg portion and a second leg portion formed from a wire, the wire configured by bending such that the first and second leg portions lie adjacent and are biased against each other for securing hair therebetween, wherein surface of the first and second leg portions is provided with an anti-slipping coating for enhancing gripping of hair arranged between the first and second leg portions by the hair pin.

Preferably, the hair pin may be provided with a first region at which, when not in use, the first and second leg portions are in contact with each other. The first and second leg portions may be in contact with each other only at the first region only. The hair pin may be provided with a second region at which the first and second leg portion are spaced apart from each other for accommodating a lock of hair therebetween. At least one of the first and second leg portions at the second region may be adapted to assume a zig-zag configuration.

In one embodiment, each of the first and second leg portions may be provided with an outwardly facing surface and an inwardly facing surface, and wherein the first and second leg portions is provided with the anti-slipping coating only on the inwardly facing surface of the first and second leg portions.

The anti-slipping coating may be made from a material selected from the group consisting of PVC, silicone, TPE, TPE foam, polyurethane, polyurethane foam and silicone-based paint.

In a preferred embodiment, the hair pin may comprise an enlarged ending at each of the first and second leg portions. The endings may be made of epoxy resin.

According to a second aspect of present invention, there is provided a method of forming a hair pin, comprising steps of providing a wire made of a metallic material, subjecting the wire to washing, coating the wire with a paint material, coating the wire with an anti-slipping material; and bending the wire by punching the wire into shape.

The anti-slipping material may be selected from the group consisting of PVC, silicone, TPE and TPE foam.

Preferably, the hair pin may comprise a first leg portion and a second leg portion with oppositely facing surfaces, and wherein the anti-slipping material is applied to only the oppositely facing surfaces of the first and second leg portions.

In an embodiment, the hair pin may be provided with a first region at which, when not in use, the first and second leg portions are in contact with each other. The first and second leg portions may be in contact with each other only at the first region only. The hair pin may be provided with a second region at which the first and second leg portion are spaced apart from each other for accommodating a lock of hair therebetween. At least one of the first and second leg portion at the second region may be adapted to assume a zig-zag configuration.

BRIEF DESCRIPTION OF THE DRAWINGS

Some embodiments of the present invention will now be explained, with reference to the accompanied drawings, in which:—

DETAILED DESCRIPTION OF PREFERRED EMBODIMENTS OF THE INVENTION

The present invention is generally concerned with a hair clipping device for securing hair or otherwise organizing hair.

Figure 1:
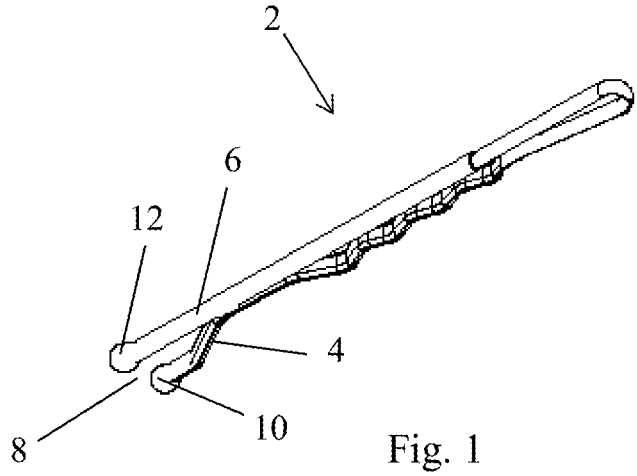
FIG. 1 is a perspective view of an embodiment of a hair pin according to the present invention.
Figure 2:
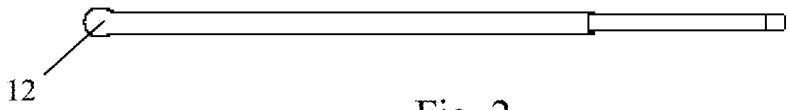
FIG. 2 is a bottom view of the hair pin of FIG. 1.

FIG. 1 shows an embodiment of a hair clipping device in the form of a hair pin according to the present invention. The hair pin is generally designated 2 and has an elongate body. The elongate body is made of a metallic wire 1 which is somewhat flattened such that the cross section of the wire roughly resembles an oval shape. Please see FIG. 4. The hair pin 2 has a first leg portion 4 and a second leg portion 6. The hair pin 2 is formed with the wire 1 bent from an essentially straight profile to such that the first leg portion 4 and the second portion 6 are brought together.

Figure 3:
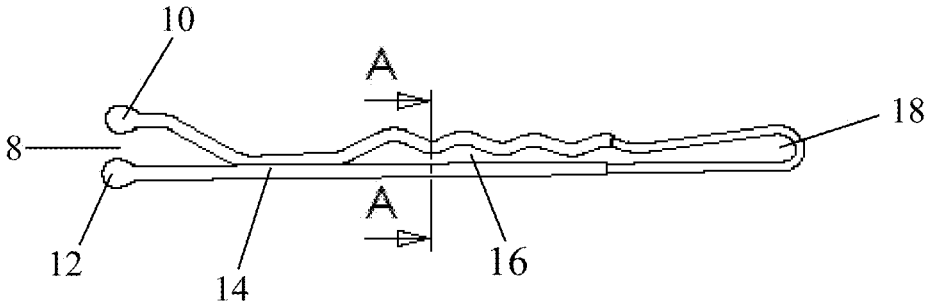
FIG. 3 is a side view of the hair pin of FIG. 1.

Referring to FIG. 3, it is shown that the hair pin 2 has an opening 8 defined by the endings 10, 12 of the first and second leg portions 4, 6. In use, the hair pin is moved towards hair to be secured with the hair entering spacing between the first and second leg portions 4, 6 via the opening 8. In this embodiment, the endings 10, 12 are capped with enlarged and round members made of an epoxy resin to facilitate movement of the hair pin 12 in use. It can been seen from the figure that the hair pin 2 is provided with a first region 14 at which the first leg portion 4 and the second leg portion 6 are in contact with each other. This first region 14 is situated at or adjacent to the enlarged endings. The hair pin 2 is also provided with a second region 16 at which the first leg portion 4 and the second leg portion 6 are spaced apart from each other. In the second region 16, spacing is provided to accommodate hair that is secured therein. In this embodiment, the first leg portion 4 at the second region 16 is configured to assume a zig-zag profile. This profile enhances gripping of hair positioned between the first and second leg portions 14, 16. The hair pin 2 is provided with a third region 18 which acts as a hinge providing springy action for biasing the first and second leg portions 4, 6 towards each other.

Figure 4:
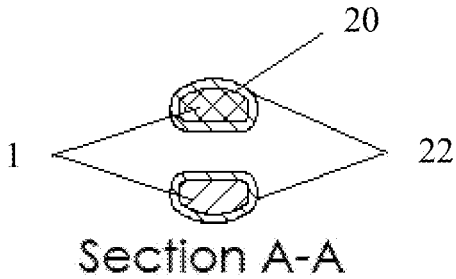
FIG. 4 is a cross section view of the hair pin of FIG. 3.
Figure 5:
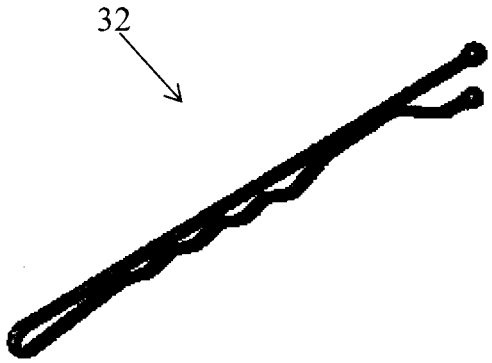
FIG. 5 is a perspective view of another embodiment of a hair pin according to the present invention.
Figure 6:
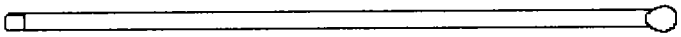
FIG. 6 is a bottom view of the hair pin of FIG. 5.
Figure 7:
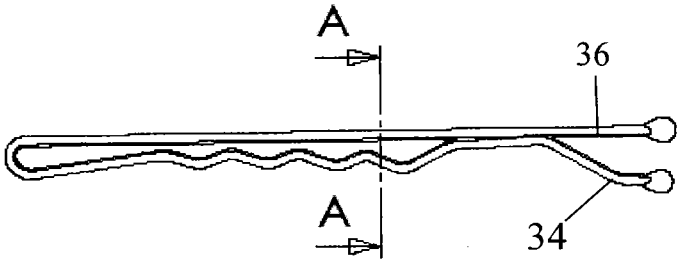
FIG. 7 is a side view of the hair pin of FIG. 5.
Figure 8:
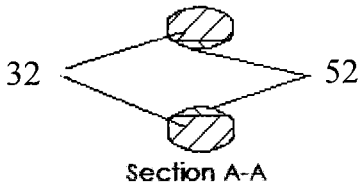
FIG. 8 is a cross section view of the hair pin of FIG. 5.

Referring to FIG. 4, it is shown that the hair pin 2 is provided with a first coating 20 adhered to the surface of the wire 1. This coating 20 is to provide desired coloring and protection to the hair pin 2.

Also referring to FIG. 4, the hair pin 2 is provided with a second coating 22 covering most of the surface of the first and second leg portions 4, 6. In other words, the second coating 22 covers both outwardly facing surface and inwardly facing surface of the first and second leg portions 4, 6. The second coating 22 is made of an anti-slipping material for minimizing movement of the hair pin 2 once fitted to a lock of hair. The anti-slipping coating may be made from a material selected from the group consisting of PVC, silicone, TPE, TPE foam, polyurethane, polyurethane foam and silicone-based paint.

FIG. 3 shows that the hinge portion 18 of the hair pin 2 is provided with the first coating 20 of paint but not the second coating 22 of anti-slipping material. This is because the hinge portion 18 does not serve to secure hair. Further, applying the second coating 22 to the hinge portion would interfere working of the hair pin 2 in use.

The hair pin 2 is made by firstly providing a wire 1 with circular cross section. The wire 1 is subjected to a flattening step. After flattening, the wire 1 is undergone washing which can assist coating of material thereon. Then the wire 1 is subjected to application of the first coating 20, followed by the second coating 22. The first coating 20 may be applied by spraying a paint thereon. The second coating 22 may be applied by dipping the wire into the anti-slipping material on opposite ends of the wire. After the second coating 22 has been dried, the coated wire is subjected to a punching step such that the wire forms into the shape of the hair clip 2 with the two legs situated next to each other.

FIGS. 5-8 show a second embodiment of a hair pin 32 according to the present invention. The hair pin 32 as shown in FIGS. 5-8 is generally similar to the above hair pin 2 shown in FIGS. 1-4. One main difference is that a second coating 52 of anti-slipping material is applied to only inwardly facing surface of the hair pin 32 and not outwardly facing surface of the hair pin 32. This is technically advantageous in use in a multi-fold manner. First, only hair secured between the two legs 34, 36 is discouraged from unintentionally slipping away, and surrounding hair that is not to be secured can slide or otherwise move freely on the outwardly facing surface of the hair pin. Otherwise, orientation of the hair would be interfered by the outwardly facing surface of the hair clip. For example, an inner layer of hair may be tightly secured by the hair pin 32, and an outer layer of hair can cover the secured inner layer without having its natural movement be restricted the outwardly facing surface of the hair pin. Further, the inwardly facing surface of the coated wire has a convex surface. Second, the free of any anti-slipping coating at the upwardly facing surface would not change the paint or other aesthetic decoration on the outwardly facing surface. This is to be contrasted with different configurations in which anti-slipping coating is applied on entire circumferential surface of the legs. Application of anti-slipping coating on the entire circumferential surface of the legs would introduce excess friction such that it would interference to wearing or removal of the clips during use.

The method of manufacture of the hair pin is similar to that of the hair in 2, except the anti-slipping coating is applied only on the inwardly facing surface.

It should be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. It is to be noted that certain features of the embodiments are illustrated by way of non-limiting examples. Also, a skilled person in the art will be aware of the prior art which is not explained in the above for brevity purpose.

The invention claimed is:

1. A method of forming a hair clip having a first leg portion and a second leg portion biased towards and at default are in contact with each other, for gripping hair positioned therebetween, comprising:

a) providing a wire made of a metallic material;

b) subjecting the provided wire to washing;

c) providing a first coating of a paint material on both outwardly and inwardly facing surfaces of the washed wire;

d) providing a second coating of an anti-slipping material on the first coating over only the inwardly facing surface of the wire by way of brushing; and e) bending the wire with the first and second coatings by punching the wire into a shape so that the wire forms the first and second leg portions of the hair clip with a first region including linearly extending portions of the first and second leg portions that are parallel to each other and in abutment along the second coatings thereof at default of the hair clip, wherein the second coating forms a convex inner surface of the first and second leg portions, and wherein the anti-slipping material of the second coating is selected from the group consisting of PVC, silicone, and silicone-based paint.

2. A method as claimed in claim 1, wherein, when the hair clip is at default, the first and second leg portions are in contact with each other at the first region only.

3. A method as claimed in claim 2, wherein bending the coated wire further forms a second region of the first and second leg portions at which portions of the first and second leg portion are spaced apart from each other for accommodating a lock of hair therebetween when the hair clip is at default.

4. A method as claimed in claim 3, wherein at least one of the first and second leg portions at the second region forms a zig-zag configuration.

5. A method as claimed in claim 1, wherein the inwardly facing surface of the wire is substantially planar.

6. A method as claimed in claim 1, wherein the providing of the wire, the subjecting the wire to washing, the providing of the first coating, the providing of the second coating, and the bending of the coated wire are performed sequentially.

* * * * *